US005603781A

United States Patent [19]

Park et al.

[11] Patent Number: 5,603,781

[45] Date of Patent: Feb. 18, 1997

[54] METHOD FOR INHIBITING THE OXIDATION OF HARD METAL POWDER

[75] Inventors: Jong-Ku Park, Namyangji; Sona Kim, Seoul, both of Rep. of Korea

[73] Assignee: Korea Institute of Science and Technology, Seoul, Rep. of Korea

[21] Appl. No.: 520,270

[22] Filed: Aug. 28, 1995

[30] Foreign Application Priority Data

Apr. 27, 1995 [KR] Rep. of Korea ..... 95-10063

[51] Int. Cl.[6] ..... B22F 1/00

[52] U.S. Cl. ..... 148/513; 75/363; 148/514

[58] Field of Search ..... 148/513, 514; 75/240, 363

[56] References Cited

U.S. PATENT DOCUMENTS 4,534,935 8/1985 Ambrose et al. ..... 148/514

5,320,800 6/1994 Siegel et al. ..... 148/514

OTHER PUBLICATIONS

Metal Powder Industries Federation, pp. 451–482, 1990, R. M. German, "Powder Injection Moulding".

MPR, pp. 812–815, Dec. 1988, Dr. Poniatowski, et al., "Injection Moulding of Tungsten Carbide Base Hard Metals".

Powder Mettalurgy 1994, pp. 1181–1184, 1994, N. P. Dalskov, et al., "Injection Moulding of Hard Metal Components".

Powder Metallurgy 1994, pp. 1121–1124, 1994, D. Bialo, et al., "Water Soluble Binder for Mim".

*Primary Examiner*—George Wyszomierski

*Attorney, Agent, or Firm*—Oblon, Spivak, McClelland, Maier & Neustadt, P.C.

[57] ABSTRACT

A method for inhibiting the oxidation of powder of a hard metal, characterized by heat-treating the milled powder of a hard metal at a temperature between about 300° C. and 500° C. for at least 1 hr in vacuum is disclosed.

6 Claims, No Drawings

METHOD FOR INHIBITING THE OXIDATION OF HARD METAL POWDER

BACKGROUND OF THE INVENTION

1. Field of the Invention

The present invention relates to a method for inhibiting the oxidation of hard metal powder in preparing sintered hard metals. More particularly, the invention relates to a method for reducing the oxidation when the hard metal powder is exposed to high temperatures in preparing the sintered hard metals using an injection molding method, by heat-treating the milled powder of the hard metal so as to remove the energy in the powder accumulated during milling.

2. Description of the Prior Art

Hard metals are meant alloys in which, for example, tungsten carbide and cobalt are mixed together. Hard metals are widely used as materials for various tools such as cutting tools, wear-resistant tools, impact-resistant tools, and so forth, since they have high hardness and high toughness. A typical fine structure of hard metal has a shape of a faceted form of tungsten carbide particulate embedded in a cobalt matrix.

A general method for preparing the sintered hard metals is as follows: Cobalt powder is initially mixed with tungsten carbide powder to give a mixture having a predetermined composition, and then the mixture is introduced into a vessel made of a hard metal or steel together with balls of a hard metal, followed by mixing and concurrently pulverizing by rotating the vessel (so called as "milling process"). For effective pulverization and mixing, acetone, alcohol or hexane is added thereto, and optionally high molecular weight additives such as paraffin are added in a small amount at the final stage of milling. A mixture (i.e., slurry) after milling is dried and granulated. The granulated hard metal powder is poured into a mold cavity having a desired shape and pressed to form a shaped compact. The shaped compact is charged into a vacuum furnace and sintered by heating [see, Hasashi Suzuki, "Hard Metal, and Sintering Hard Materials (Fundamental and Application)," Maruzen Kabushiki Kaisha (1986)].

The key to manufacturing a sintered hard metal is the milling step, which provides a sintered body having a uniformly fine structure. However, during this step, the hard metal powder, in particular, tungsten carbide powder is pulverized into smaller pieces by colliding with balls of a hard metal, and simultaneously a greater amount of energy is accumulated therein. Thus, milled hard metal powder has high reactivity with oxygen. Although serious problems do not occur when the hard metal powder thus milled is sintered by a conventional manufacturing process, such as a vacuum sintering process, oxidation of the powder cannot be avoided due to the increased activity when the powder is exposed to somewhat high temperatures in air. In order to prepare a sintered body of a hard metal using an injection molding method, the hard metal powder should be mixed with a binder of mixture of polymers by heating the mixture to a temperature higher than melting temperature of the binder; the mixture with low viscosity is injected into a mold cavity by applied pressure. The polymer binder in the molded compact should be removed, so called as "debinding", before vacuum sintering. During mixing and debinding, the milled hard metal powder having high activity will be exposed to high temperatures for long time [see, R. M. German, Powder Injection Molding, Metal Powder Industries Federation (1990)]. At that time, if there is oxygen in the atmosphere, it is necessary to add an antioxidant or to block the oxygen in order to inhibit oxidation of the hard metal powder [see, N. P. Dalskov and O. Kraemer, Injection Moulding of Hard Metal Components, Powder Metallurgy World Congress—PM '94 vol. II, p.1181 (1994); Dr. Poniatowski and G. Will, Injection Moulding of Tungsten Carbide Base Hard metals, Metal Powder Report, p. 812 (1988)].

We, the inventors have conducted extensive experimentation in order to solve the above problems. As a result, we found that when hard metal powder that has been milled in the manufacturing process is subjected to heat treatment at a temperature between about 300° C. and 500° C. for at least 1 hr in vacuum, its activity can be reduced due to the removal of the energy accumulated in the hard metal powder, and thus, the oxidation of the hard metal which otherwise occurs when the hard metal powder is exposed to high temperatures in preparing a hard metal through injection molding can be reduced.

SUMMARY OF THE INVENTION

It is therefore an object of the present invention to provide a method for inhibiting the oxidation in the manufacturing of a hard metal by heat-treating milled powder of the hard metal at a temperature between about 300° C. and 500° C. for at least 1 hr in vacuum.

Other objects of the invention will become apparent through reading the remainder of the specification.

DETAILED DESCRIPTION OF THE INVENTION

According to the present invention, a method is provided for inhibiting the oxidation which occurs when a hard metal powder is exposed to high temperatures in preparing a hard metal using an injection molding method is provided. The method according to the invention comprises heat-treating milled powder of the hard metal at a temperature between about 300° C. and 500° C. for at least 1 hr in vacuum.

If the heat-treatment is carried out at below 300° C., it is economically inefficient because the energy accumulated in the milled powder of the hard metal is removed slowly. At above 500° C., the milled powder does not retain its original shape and forms weak bonds with powders neighbored.

According to the present invention, the heat treatment may be performed for at least 1 hr, preferably for about 10 hrs. Also, the heat-treatment is preferably performed at a pressure of 0.1 torr or less.

The milled hard metal powder is oxidized by oxygen in the air when it is exposed to the air at high temperatures. The hard metal powder which has been milled for more than about 72 hrs is oxidized rapidly in 10 to 15 minutes after being exposed to air at temperatures of 150° C. or above. However, a mixture of tungsten carbide powder and cobalt powder which has not been milled is not oxidized to a significant extent even at 200° C. It has been found that the difference in the oxidation behaviors between the milled powder and non-milled powder is attributed to the energy introduced during the milling process. When the milled powder was not used immediately but was heat-treated for 10 hrs at a temperature of 300° C. or above, the oxidation occurred only to a minor extent even when the powder was exposed to a temperature of 200° C. in the subsequent injection molding process.

The following examples are provided for illustration purposes and the invention is not limited thereto.

EXAMPLE 1

Hard metal balls were charged into a vessel, the inner wall of which is lined with a hard metal, in an amount of one third of its total volume. Then, WC-10% Co (by weight ratio) mixed powder was added thereto in an amount of 30% of the weight of the hard metal balls, and then the vessel was rotated on a rotator for 72 hrs. A slurry of the mixed powder thus milled was dried in a vacuum oven and then granulated. The resulting granules were heat-treated at a temperature of 300° C. for 10 hrs while maintaining a pressure of less than 0.1 torr. 2.5 g of each of the granulated powder, vacuum heat-treated powder and non-milled mixed powder was compacted at a pressure of 25 MPa, charged into a tubular furnace at a constant temperature, and oxidized in the air, respectively. Changes in their weights were measured. The temperature in the oxidation test was changed to 150° C., 175° C., 200° C., 250° C., and 300° C., respectively. The degree of the oxidization of the compact of the milled powder was almost negligible at 150° C., but at higher temperatures, the rate of the initial oxidation (i.e., within 15 minutes) was rapid and then decreased sharply. On the other hand, the compacts of simply mixed powder which was not milled, and vacuum heat-treated powder showed minimal oxidation even at 250° C. The results of the oxidation test for each powder are summarized in Table 1.

TABLE 1

Results of Oxidation Test for WC-10% Co Mixture Powder

| Type of powder | Temp. of oxidation test | Weight increase (%) | Initial oxidation time (min) |
|---|---|---|---|
| Simple mixed powder | 200 | ~0 | — |
| | 250 | ~0 | — |
| | 300 | 0.6 | 10 |
| Milled powder | 150 | ~0 | — |
| | 175 | 1.6 | 13 |
| | 200 | 1.8 | 12 |

TABLE 1-continued

Results of Oxidation Test for WC-10% Co Mixture Powder

| Type of powder | Temp. of oxidation test | Weight increase (%) | Initial oxidation time (min) |
|---|---|---|---|
| Vacuum heat-treated powder after milling | 200 | ~0 | — |
| | 250 | ~0 | — |
| | 300 | 0.8 | 10 |

EXAMPLE 2

An oxidation test was carried out in the same manner as described in Example 1, except that the heat-treatment was performed at 500° C. (instead of 300° C.). The oxidation behavior of the resulting powder was not greatly different from those in Example 1. At above 500° C., the milled powder did not retain its original shape while forming weak bonds with powders neighbored.

What is claimed is:

1. A method for inhibiting the oxidation of powdered material comprising carbide particulates in a metal matrix, comprising heat-treating a milled powder of said material for at least one hour in a vacuum at a temperature between 300° and 500° C.

2. The method of claim 1, wherein said vacuum is below 0.1 torr.

3. The method of claim 1, wherein said heat-treatment is carried out for about 10 hrs.

4. The method of claim 1, wherein said vacuum is below 0.1 torr, and wherein said heat-treatment is carried out for about 10 hrs.

5. The method of claim 1, wherein said material is a mixture of tungsten carbide and cobalt.

6. The method of claim 5, wherein said material is a mixture of tungsten carbide and cobalt and comprises cobalt in an amount of 10% by weight.

* * * * *